United States Patent [19]

Schwartz

[11] 4,346,553

[45] Aug. 31, 1982

[54] HELICALLY WRAPPED YARN

[75] Inventor: Ira Schwartz, Villanova, Pa.

[73] Assignee: Conshohocken Cotton Co., Inc., Conshohocken, Pa.

[21] Appl. No.: 92,997

[22] Filed: Nov. 9, 1979

[51] Int. Cl.[3] ..... D02G 3/36; D02G 3/38

[52] U.S. Cl. ..... 57/210; 57/16; 57/207; 57/227

[58] Field of Search ..... 57/16–18, 57/210, 224, 227, 228, 229, 232, 207

[56] References Cited

U.S. PATENT DOCUMENTS

| | | | |
|---|---|---|---|
| 2,311,356 | 2/1943 | Astley | 57/224 |
| 2,449,595 | 9/1948 | Ellis | 57/224 X |
| 3,643,416 | 2/1972 | Andrews et al. | 57/210 X |
| 3,675,409 | 7/1972 | Rosenstein | 57/229 |
| 3,769,787 | 11/1973 | Rosenstein et al. | 57/227 |
| 3,831,369 | 8/1974 | Northup et al. | 57/210 X |
| 3,978,648 | 9/1976 | Yamagata et al. | 57/224 |
| 4,028,874 | 6/1977 | Maag et al. | 57/210 |

*Primary Examiner*—John Petrakes
*Attorney, Agent, or Firm*—Austin R. Miller

[57] ABSTRACT

A core yarn has a plurality of wrapper yarns wrapped under tension in both the clockwise and counterclockwise directions. The core is composed of staple fibers having substantially no twist so that the core has substantially zero tensile strength. The tensions on the wrapper yarns are balanced by each other and are so high as to compress the core and impart to the core a sinuous configuration along its length.

10 Claims, 7 Drawing Figures

HELICALLY WRAPPED YARN

This invention relates to a novel helically wrapped yarn, and to a method for making the same. More particularly, the invention relates to a helically wrapped yarn having a unique sinuous configuration extending along its length, and having the remarkable characteristics of extreme softness coupled with excellent tensile strength. Still further, the invention relates to a yarn having all of the foregoing characteristics, and which has outstanding properties of knitability, weavability and processability to form a wide variety of highly desirable and novel fabrics. The invention further relates to novel processes for making yarns of various types having the novel characteristics of this invention, and for producing novel fabrics from the yarns.

DISCUSSION OF THE PRIOR ART

Helically wrapped yarns are well known per se. The patent to Rosenstein et al U.S. Pat. No. 3,769,787 discloses a yarn comprising a core having a plurality of multifilament synthetic yarn, maintained coherent and compact for high speed fabricating purposes, by continuously disposing special wrapper filaments in generally helical paths around the core filaments of the yarn, at least one such wrapper filament being disposed in a clockwise manner and another wrapper filament counterclockwise. In the method utilized by the patent to Rosenstein et al, the wrapper filaments are continuously applied from over the ends of supply packages, and are continuously wrapped around the core. The core filaments, as stated, are synthetic filaments, and the wrapper filaments are applied to the core under low tension. In accordance with the disclosure of Rosenstein et al, the filaments may be either drawn or undrawn, and the helically wrapped product may be drawn subsequent to formation.

Another patent to Rosenstein U.S. Pat. No. 3,675,409 discloses a multifilament tow which is rendered compact by continuously disposing wrapper yarns in generally helical paths around the tow, one clockwise and the other counterclockwise. Again, the purpose of the helical wrapping is to render the filaments of the core compact, so that they can be readily handled in subsequent packaging operations. Of course, the tows contemplated in the Rosenstein U.S. Pat. No. 3,675,409 are not intended for weaving or knitting, or for formation into fabrics of any kind, because they are of drastically heavier denier than yarns, having deniers of at least 3,000 and running up to deniers of 500,000 to 1,000,000, for example.

It is also known, as disclosed in the patent to Ellis U.S. Pat. No. 2,449,595, to reinforce a plastic material by utilization of yarns running through the center of the material, and also with the use of yarns helically wrapped around the material. Ellis further discloses the utilization of warp threads, arranged to weave together a multiplicity of such materials, and the warp threads are used to apply tension to the material in the weaving operation. Again, the purpose of the helical threads utilized in the Ellis patent is to hold the plastic material intact, for handling purposes.

OBJECTS OF THIS INVENTION

In sharp contrast to the disclosures of the prior art, it is an object of the present invention to provide a yarn which has an extremely soft hand, sharply distinguishable from the feel and texture of the synthetic-core product of the Rosenstein et al U.S. Pat. No. 3,769,787, but which is a yarn in every sense of the word, being ideally suited to knitting, weaving or other fabricating operations, as sharply distinguished from the tow of the Rosenstein U.S. Pat. No. 3,675,409. Another object of this invention is to provide a yarn having a core composed of discontinuous filaments, having essentially no tensile strength of their own, and to confer upon such a core sufficient tensile strength to permit the yarn to undergo high speed fabricating operations and to produce a highly desirable product having essentially the softness and fine hand of the original core.

Other objects and advantages of this invention, including the provision of a highly attractive and novel yarn having a graceful sinuous configuration extending along its length, will appear in further detail hereinafter.

DRAWINGS

Figure 2:
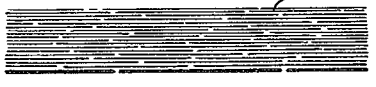
FIG. 2 is a highly enlarged schematic view showing a typical sliver or roving from which the yarn of this invention may be made.

Turning now to the specific forms of the invention selected for illustration in the drawings, which are intended for illustrative purposes and not as limiting the scope of the appended claims, FIG. 2 shows a portion of a sliver or roving 10, having a multiplicity of relatively short length, discontinuous fibers such as fibers of cotton, for example. The sliver or roving 10 has substantially no strength, and readily pulls apart when an effort is made to subject it to tension.

Figure 1:
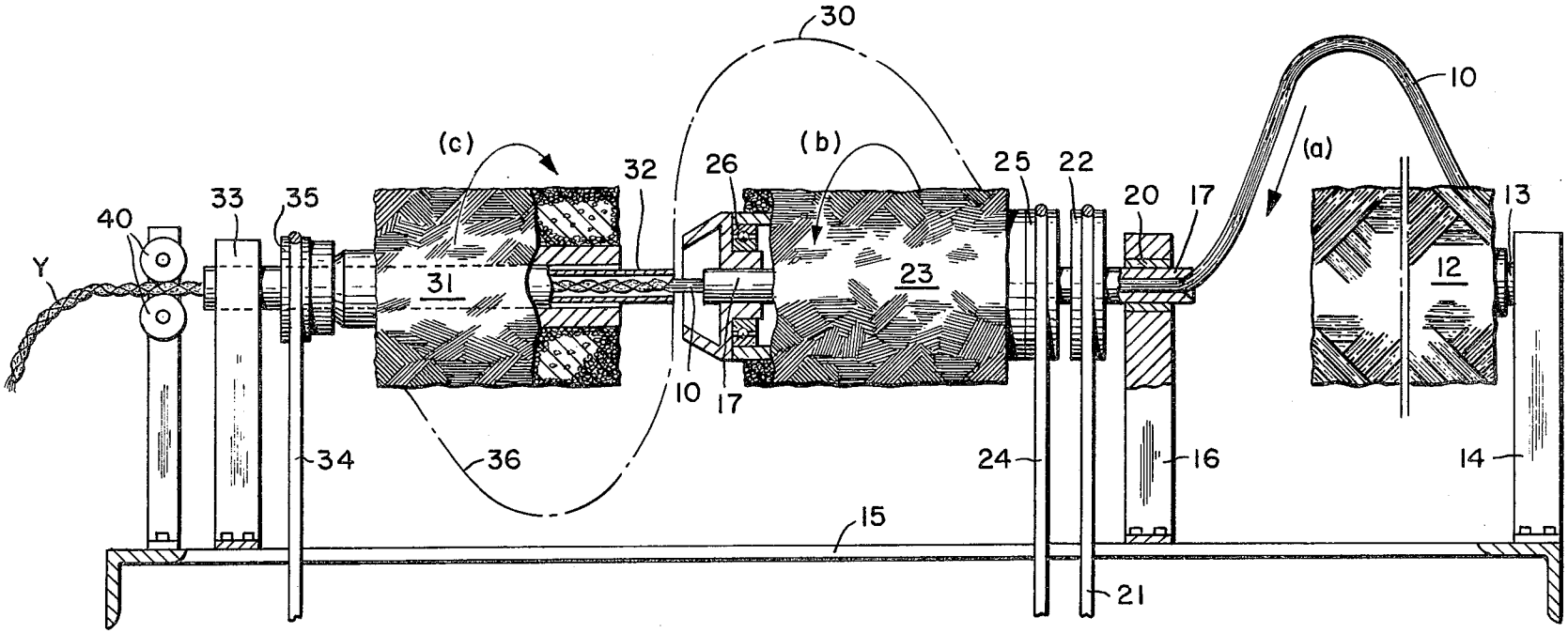
FIG. 1 is a view in side elevation, with certain parts broken away and others shown in section in order to reveal important details, showing one embodiment of apparatus for producing a novel yarn in accordance with this invention.

The sliver or roving of FIG. 2 appears in FIG. 1 as a package 12, mounted on a spindle 13 carried by a supporting member 14 mounted on a machine frame 15. Means are preferably provided, not shown, for revolving the package 12 in order to supply the sliver or roving 10 to the process in accordance with this invention, thus causing the roving to balloon out as it travels along the path indicated by the arrow (a) at the right side portion of FIG. 1.

The number 16 designates another support member mounted on the frame 15, and carrying a hollow spindle 17 through which the sliver or roving 10 is conducted. The spindle is rotatively mounted in a bearing 20, and is driven in rotation by a drive belt 21 operating through a pulley 22.

Mounted on the spindle 20 is a yarn package 23 composed of a wrapper yarn to be applied to the core composed of sliver or roving 10 in accordance with this invention. Means are provided for rotating the package 23 in the direction of the arrow (b) which appears in the central portion of FIG. 1, such means including a drive belt 24 and a drive pulley 25. As is shown in FIG. 1, the package 23 is mounted on bearings 26 for rotation relative to the rotation of the spindle 17. The dot-dash line 30 at the central portion of FIG. 1 shows the yarn ballooning out in the course of its rotation, as it is removed from the yarn package 23 in accordance with this invention.

The number 31 designates another yarn package, arranged downstream of the package 30, and mounted on a separate spindle 32 substantially aligned with the spindle 17. The spindle 32 is mounted for rotation about its own axis and is supported by a support 33 mounted on the machine frame 15. Spindle 32 is hollow, permitting passage of yarn through its center. Means are provided for driving the yarn package 31 in rotation, including the drive belt 34 and the drive pulley 35, which are driven in the direction to rotate the yarn package 31 as indicated by the arrow (c) appearing at the left hand portion of FIG. 1.

The direction of rotation (c) is opposite to the direction of rotation (b) applied to the package 23. Thus, the two packages 23, 31 are caused to rotate in opposite directions relative to each other. The rotation of the package 31 in the direction (c) causes a ballooning of the yarn 36 as it is removed from the package 31. While the yarn 36 is arranged to move in a direction opposite to the flow of the yarn core composed of the sliver or roving 10, thus flowing in an upstream direction with respect to such core, the yarn 30 from package 23 is caused to move in a downstream direction, opposite to the direction of movement of the yarn 36 from the package 31. Thus, the two wrapper yarns 30, 36 are caused to converge at the entrance to the spindle 32, and to join there with the fibers of th core 10. The numbers 40, 40 designate conducting rollers for the yarn Y comprising the product produced by the apparatus and method illustrated in FIG. 1 of the drawings.

It will accordingly be appeciated that, in the operation of the apparatus, the spindle 17 is rotated in a manner to apply a false twist to the sliver or roving 10, thus giving it sufficient momentary strength to resist the forces involved in the subsequent processing steps of this invention. In some instances it is possible to dispense with the application of such false twist, but in many situations, particularly during start up time, the application of false twist is desirable. Of course, the false twist becomes detwisted as the yarn is released from any downstream restraining means such as the downstream rolls 40, 40.

Figure 7:
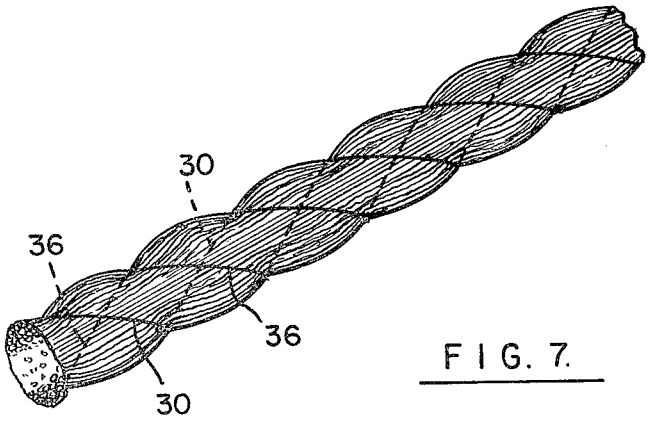
FIG. 7 is a highly enlarged perspective view of a typical yarn produced in accordance with this invention.

It will be further appreciated that, in the course of operation of the apparatus, the yarns 30, 36 converge upon each other and are wrapped in opposite directions, substantially helically, around the core 10. The yarn packages 23, 31 are rotated at high speeds, such as 6,000 r.p.m., for example, thus applying high tension to the yarns 36, 30 as they converge upon each other and as they wrap themselves about the core 10. This high tension, coupled with the compressible nature of the core itself, produces a novel and highly desirable wrapped configuration to the core, as is illustrated in FIGS. 3 and 7.

Figure 3:
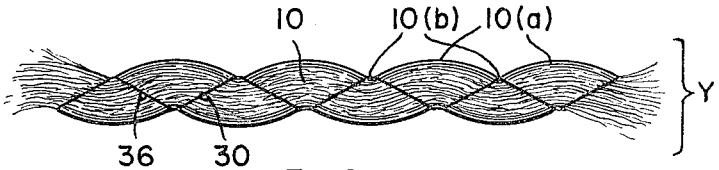
FIG. 3 is a highly enlarged view showing a typical yarn produced in accordance with this invention.

FIG. 3 of the drawings shows the sinuous nature of a typical portion of yarn produced in accordance with this invention. The core is composed, of course, of soft, discontinuous fibers such as cotton or the like, having essentially no tensile strength of its own. Wrapped around the core in a helical manner, alternately clockwise and counterclockwise, are the yarns 36 and 30. As is shown in FIG. 3, the tension upon the yarns 36 and 30 is so high as to compress the core at the points where the helically wrapped yarns cross each other, substantially reducing its diameter locally. Further, the yarn Y has a sinuous configuration extending along its length. It is seen clearly in FIG. 7, because of the perspective nature of the view, that the wrapper yarns 30, 36 are wrapped helically and continuously, and in opposite directions.

Figure 4:
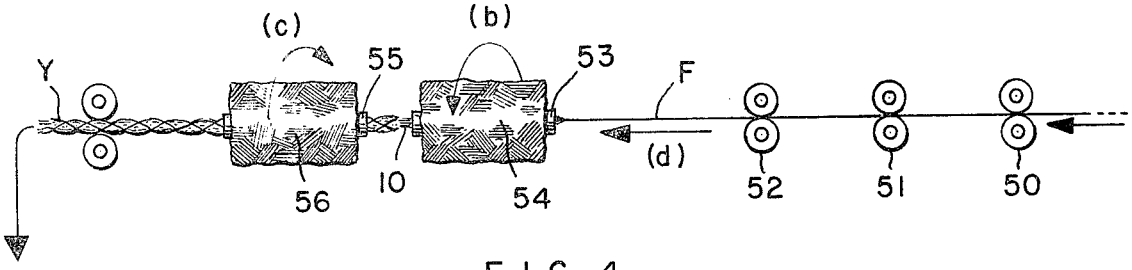
FIG. 4 is a schematic view showing one way in which the process of this invention may be applied to fibrous material directly provided by a draw frame.

Turning now to FIG. 4 of the drawings, the numbers 50, 51 and 52 represent draw rolls, which comprise a portion of a typical draw frame, for example. Since such draw frames are well known in the art, of themselves, specific details have been omitted in the interest of clarity. As is well known, the rolls 52 revolve at slightly greater peripheral speeds than the rolls 51, and the rolls 51 have peripheral speeds slightly in excess of those of rolls 50. In this manner, the sliver is drawn, producing a multiplicity of substantially parallel fibers F arranged in sheet formation, moving in the direction of the arrow (d). In accordance with this invention these are fed directly to the hollow spindle 53 of package 54, and then through the hollow spindle 55 of package 56. As in FIG. 1, the package 54 rotates in the direction of the arrow (b) and the package 55 rotates in the direction of the arrow (c). Because of friction between the fibers and the inner wall of spindle 53, a false twist is applied to the sheet of fibers F, and this false twist backs up to the downstream drafting rollers 52. This provides sufficient temporary strength to the fibers F to permit them to remain intact as a core 10 during the yarn formation process of this invention.

As in the case of FIG. 1, the yarns from packages 54 and 56 are wrapped under high tension around the core 10, producing the yarn Y.

Figure 5:
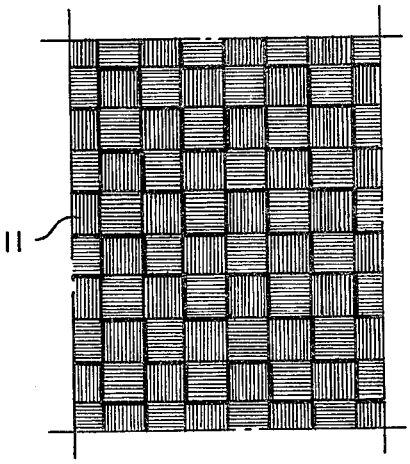
FIG. 5 represents a novel fabric produced in accordance with one aspect of this invention.
Figure 6:
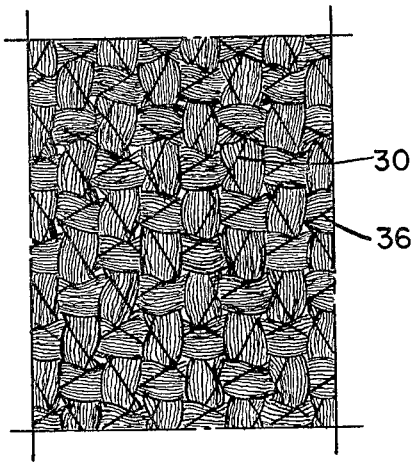
FIG. 6 is a view similar to FIG. 5, showing the fabric of FIG. 5 in one stage of its preparation.

FIG. 5 illustrates a novel fabric composed entirely of fibers 11, which are the same fibers heretofore discussed in connection with the sliver or roving 10 of FIG. 2. Since such sliver or roving has substantially no tensile strength, it is exceedingly difficult if not impossible to produce a woven fabric by direct weaving of the sliver or roving. However, in accordance with this invention a unique and highly desirable fabric may be produced by providing wrapper yarns 30, 36 which are removable yarns, being removable either by way of solubility in water or some other liquid which does not attack or dissolve the fibers of the core, or as heat-meltable yarns which may subsequently be removed by the application of heat. In accordance with this invention, the yarns Y may be woven to produce a woven fabric as shown in FIG. 6, and the wrapper yarns 30, 36 are then removed in a manner to produce the fabric of FIG. 5.

It is important to observe in accordance with this invention that the core 10 is composed of fibers so arranged that the core has substantially zero tensile strength, and that the plurality of wrapper yarns 30, 36 are wrapped under tension in both the clockwise and the counterclockwise directions around the core, whereby the wrapper yarns periodically cross over one another. It is extremely important to provide a tension on the wrapper yarns so high as to compress the core in areas where the wrapper yarns cross over one another. Preferably, the core is composed of fibers so arranged that the core is compressible, and the wrapper yarn tension is so high as to reduce the diameter of the core to about 30 to 90% of its original diameter by compression in the areas where the wrapper yarns cross over one another. It is further highly desirable to provide the wrapper yarns under a tension sufficient to apply to the core a sinuous configuration extending along its length, as illustrated for example in FIG. 3 of the drawings, and to provide a configuration wherein portions 10(*a*) of the core protrude laterally outwardly away from the areas 10(*b*) where the wrapper yarns cross over one another.

Preferably in accordance with this invention, the staple fibers of the core are substantially free of twist. Although in some embodiments of the invention a false twist is applied to the staple fibers, this false twist is of course detwisted as the twist restraint is removed from the yarn during its passage through the final stages of the process. Accordingly, in the yarn product Y the fibers are preferably arranged substantially parallel to one another, and are substantially free of adhesion to one another.

It will accordingly be appeciated that in the method of this invention, wherein the yarn is made from a core of staple fibers which are so arranged that the core has substantially zero tensile strength, the wrapper yarns are continuously wrapped in both the clockwise and counterclockwise directions about the core, causing the wrapper yarns to cross over one another periodically during the wrapping step, and a tension is applied to the wrapper yarns during the wrapping step, which tension is so high as to compress the core in areas where the wrapper yarns cross over one another.

In addition to the modifications heretofore referred to in this specification, it is also possible to provide one or more of the wrapper yarns in the form of shrink yarns, characterized by shrinking upon subsequent treatment, and to combine such shrink wrapper yarns with non-shrink core fibers which are characterized by substantially not shrinking upon subsequent treatment such as heat treatment. A novel effect is accordingly obtained by applying heat treatment to such a product, causing the wrapper yarns to be wrapped under even higher tension about the filaments of the core. It is also possible to provide one or more wrapper yarns in the form of stretch yarns, producing novel effects.

The application of high tension to the wrapper yarns, as distinguished from the previously mentioned Rosenstein et al patents, is achieved in accordance with this invention by applying the respective wrapper yarns to the core at approximately the same time and place. Thus, the tension of one wrapper yarn is balanced by the tension of the other, providing opposing forces which permit the tight, high tension wrapping that is achieved in accordance with this invention. In the absence of substantially simultaneous wrapping at a preselected wrapping situs positioned at a predetermined point on the path of movement of the core 10, serious difficulty would be encountered in applying the necessary wrapping tension to the wrapper yarns.

The yarn in accordance with this invention, especially when a core of soft cotton fibers is provided, has a plurality of soft puffs extending outwardly from the axis of the yarn, providing a delightfully soft hand. The feel of the wrapper yarns is almost entirely absent, because the wrapper yarns are essentially submerged between the soft cotton puffs. This produces a yarn having the fine, soft hand of true cotton. Nevertheless, the presence of the wrapper yarns, disposed under high tension in a helical manner along the length of the yarn, provides more than adequate tensile strength for virtually all normal handling operations.

The yarn of this invention is a balanced yarn; it has no torque.

For example, the yarn in accordance with this invention is ideally adapted for hand knitting. Although in the hand knitting of an ordinary twisted cotton yarn the needle point frequently tends undesirably to penetrate between the twists and through the yarn, such tendency is substantially completely absent when hand knitting with the yarn in accordance with this invention. Further, the yarn of this invention lends itself admirably to automatic machine handling operations such as those utilized in automatic knitting machines and looms.

Similar advantages exist in fabrics which are produced from yarns in accordance with this invention. They possess the fine, soft hand of true cotton fibers, with the less attractive hand of the wrapper yarns submerged and virtually unnoticeable. Novel and attractive effects may be achieved by varying the colors of the wrapper yarns. For example, by using one wrapper yarn of a color substantially the same as the color of the core and by using a different color for the other wrapper yarn, a surprisingly attractive spiral effect can be achieved. It is possible to use overdyeing, as by dyeing a portion such as one or more wrapper yarns one color and then overdyeing or cross-dyeing to produce multicolored effects. A wide variety of other modifications may be made, including the use of multiple color effects among the core and the respective wrapper yarns.

Although this invention has been described in connection with particular apparatus and method, and with respect to particular materials and yarn configurations, it will be appreciated that many variations may be made, including the substitution of equivalent elements for those specifically shown and described, the use of certain features indepedently of other features, and reversals of sequence of method steps, all without departing from the spirit and scope as defined in the appended claims.

I claim:

1. Wrapped core yarn comprising:

(a) a core composed of fibers so arranged that the core has substantially zero tensile strength, and (b) a plurality of wrapper yarns wrapped under tension in both the clockwise and the counterclockwise directions around said core, whereby said yarns periodically cross over one another, said tensions on said wrapper yarns being balanced by each other and being so high as to compress said core in areas where said wrapper yarns cross over one another along the length of the core and impart to the core a sinuous configuration along its length.

2. The wrapped core yarn defined in claim 1, wherein the core is composed of fibers so arranged that the core is compressible, and wherein the diameter of said core is reduced to about 30–90% of its original diameter by compression in said areas where said wrapper yarns cross over one another.

3. The wrapped core yarn defined in claim 1, wherein portions of said core protrude laterally outwardly away from areas where said wrapper yarns cross over one another.

4. The wrapped core yarn defined in claim 1, wherein said fibers are staple fibers substantially free of twist.

5. The wrapped core yarn defined in claim 4, wherein said fibers are arranged substantially free of adhesion to one another.

6. The wrapped core yarn defined in claim 1, wherein said fibers are arranged substantially parallel to one another.

7. The wrapped core yarn defined in claim 6, wherein said fibers are readily pulled apart from one another.

8. The wrapped core yarn defined in claim 6, wherein said yarns are substantially helically wrapped around said core.

9. The wrapped core yarn defined in claim 1, wherein at least one of said wrapper yarns is a shrink yarn characterized by shrinking upon subsequent treatment, and wherein the fibers of said core are non-shrink fibers characterized by substantially not shrinking upon said subsequent treatment.

10. A fabric consisting essentially of the yarn defined in claim 1.

* * * * *